US007780501B2

(12) United States Patent
Kim

(10) Patent No.: US 7,780,501 B2
(45) Date of Patent: Aug. 24, 2010

(54) HULA HOOP

(76) Inventor: Taekyu Kim, 1608-3, Banyea 3-dong, Haeundae-ku, Busan-si (KR)

( * ) Notice: Subject to any disclaimer, the term of this patent is extended or adjusted under 35 U.S.C. 154(b) by 677 days.

(21) Appl. No.: 11/502,634

(22) Filed: Aug. 10, 2006

(65) Prior Publication Data

US 2007/0243792 A1 Oct. 18, 2007

(51) Int. Cl.
*A63H 33/02* (2006.01)

(52) U.S. Cl. ..... 446/236

(58) Field of Classification Search ..... 446/236
See application file for complete search history.

(56) References Cited

U.S. PATENT DOCUMENTS 1,617,972 A * 2/1927 Wallace ..... 473/299
1,817,173 A * 8/1931 Brandt ..... 428/10
2,509,748 A * 5/1950 Slavek ..... 66/170
4,380,885 A * 4/1983 Komagata ..... 446/236
4,915,666 A * 4/1990 Maleyko ..... 446/242
5,338,244 A * 8/1994 Huang ..... 446/242
5,538,454 A * 7/1996 Kessler ..... 446/236
D399,969 S * 10/1998 Lin ..... D24/200
6,309,273 B1 * 10/2001 Kim ..... 446/28
6,712,779 B1 * 3/2004 Iverson ..... 601/134

FOREIGN PATENT DOCUMENTS

DE 3619992 A * 12/1987
DE 3619992 A1 * 12/1987
WO WO 0021481 A2 * 4/2000

* cited by examiner

*Primary Examiner*—Gene Kim
*Assistant Examiner*—Alyssa M Hylinski
(74) *Attorney, Agent, or Firm*—Tutunjian & Bitetto, PC

(57) ABSTRACT

A hula hoop has a plurality of arched coupling units, which are plastic molded articles and coupled to one another in sequence to complete a circular assembly. Each coupling unit is centrally formed with an expanded acupressure portion, and has one end formed into a bolt-shaped coupling portion and the other end formed into a nut-shaped coupling portion. Thereby, the bolt-shaped coupling portion of one coupling unit is able to be forcibly fitted into and fastened to the nut-shaped coupling portion of another neighboring coupling unit. Each coupling unit is densely wound, throughout an outer peripheral surface of the overall body thereof except for the coupling portions, by a braid that is made by interweaving a plurality of strands. Metal or plastic connecting members are fitted around the respective coupling portions between the neighboring coupling units in the course of assembling of the coupling units.

4 Claims, 3 Drawing Sheets

HULA HOOP

RELATED APPLICATION

This application is related to and claims the benefit of priority from Korean Patent Application No. 20-2006-0007131, filed on Mar. 16, 2006, the entirety of which is incorporated herein by reference.

BACKGROUND OF THE INVENTION

1. Field of the Invention

The present invention relates to a hula hoop, and more particularly, to a hula hoop comprising a plurality of coupling units assembled to one another in sequence wherein: each coupling unit is centrally formed with an expanded acupressure portion and has one end formed into a bolt-shaped coupling portion and the other end formed into a nut-shaped coupling portion to enable the sequential assembling of the plurality of coupling units; each coupling unit is densely wound, throughout an outer peripheral surface of the overall body thereof except for both the coupling portions, by a braid that is obtained by interweaving a plurality of strands; and metal or plastic connecting members are fitted around the respective coupling portions between the neighboring coupling units in the course of assembling of the coupling units.

2. Description of the Related Art

In accordance with the current rush to pursue "well-being life", men, women, and children are aware of obesity and concentrate their efforts on having a slender and healthy body. The preferable method of obtaining the slender and healthy body, of course, is exercise. Therefore, many people make a large investment to go to the health club or learn yoga, dance and the like, and it is common to have at least several pieces of simple exercise equipment at home in order to do regular exercise in daily life regardless of time and place. Of various kinds of representative household exercise equipment, such as a jump rope, hula hoop, stepper and treadmill, etc., in particular, a hula hoop is one of the most popular because it offers high exercise efficiency as well as the pleasure of playing.

Recently, as it has been known that exercise using a hula hoop is efficient not only for controlling weight but also to stimulate "growth plates" of growing children, a variety of products having additional functionalities suitable to double the playing and exercise effects of the hula hoop have come into the market.

SUMMARY OF THE INVENTION

The present invention has been made in view of an improvement of the prior art, and it is an object of the present invention to provide a hula hoop which comprises a plurality of coupling units assembled to each other, each coupling unit being centrally formed with an expanded acupressure portion and having one end formed into a bolt-shaped coupling portion and the other end formed into a nut-shaped coupling portion to enable sequential fastening of the plurality of coupling units, each coupling unit being densely wound, throughout an outer peripheral surface of the overall body thereof except for both the coupling portions, by a braid that is obtained by interweaving a plurality of strands, and metal or plastic connecting members being fitted around the respective coupling portions between the neighboring coupling units in the course of assembling of the coupling units.

In accordance with the present invention, the above and other objects can be accomplished by the provision of a hula hoop comprising a plurality of arched coupling units, which are plastic molded articles and coupled to one another in sequence to complete a circular assembly, wherein: each coupling unit is centrally formed with an expanded acupressure portion; each coupling unit has one end formed into a bolt-shaped coupling portion and the other end formed into a nut-shaped coupling portion such that the bolt-shaped coupling portion of one coupling unit is forcibly fitted into and fastened to the nut-shaped coupling portion of another neighboring coupling unit; each coupling unit is densely wound, throughout an outer peripheral surface of the overall body thereof except for the coupling portions, by a braid that is made by interweaving a plurality of strands; and metal or plastic connecting members are fitted around the respective coupling portions between the neighboring coupling units in the course of assembling of the coupling units.

Preferably, the braid wound on the outer peripheral surface of each coupling unit may take any one configuration selected from among configurations in that winding beginning and ending portions of the braid are thermally bonded to be integrated to the outer peripheral surface of the coupling unit, that each coupling unit is perforated with holes at positions corresponding to the winding beginning and ending portions of the braid and the winding beginning and ending portions of the braid are knotted in the holes after the braid is wound on the coupling unit, and that the winding beginning and ending portions of the braid are pushed below the braid tightly wound on the coupling unit to be caught and fixedly maintained by a winding force of the braid.

Preferably, six coupling units may be assembled to constitute a children's hula hoop, and eight coupling units are assembled to constitute an adult hula hoop.

Preferably, the braid may be made by interweaving sixteen strands.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained in detail with reference to the accompanying drawings.

Figure 1:
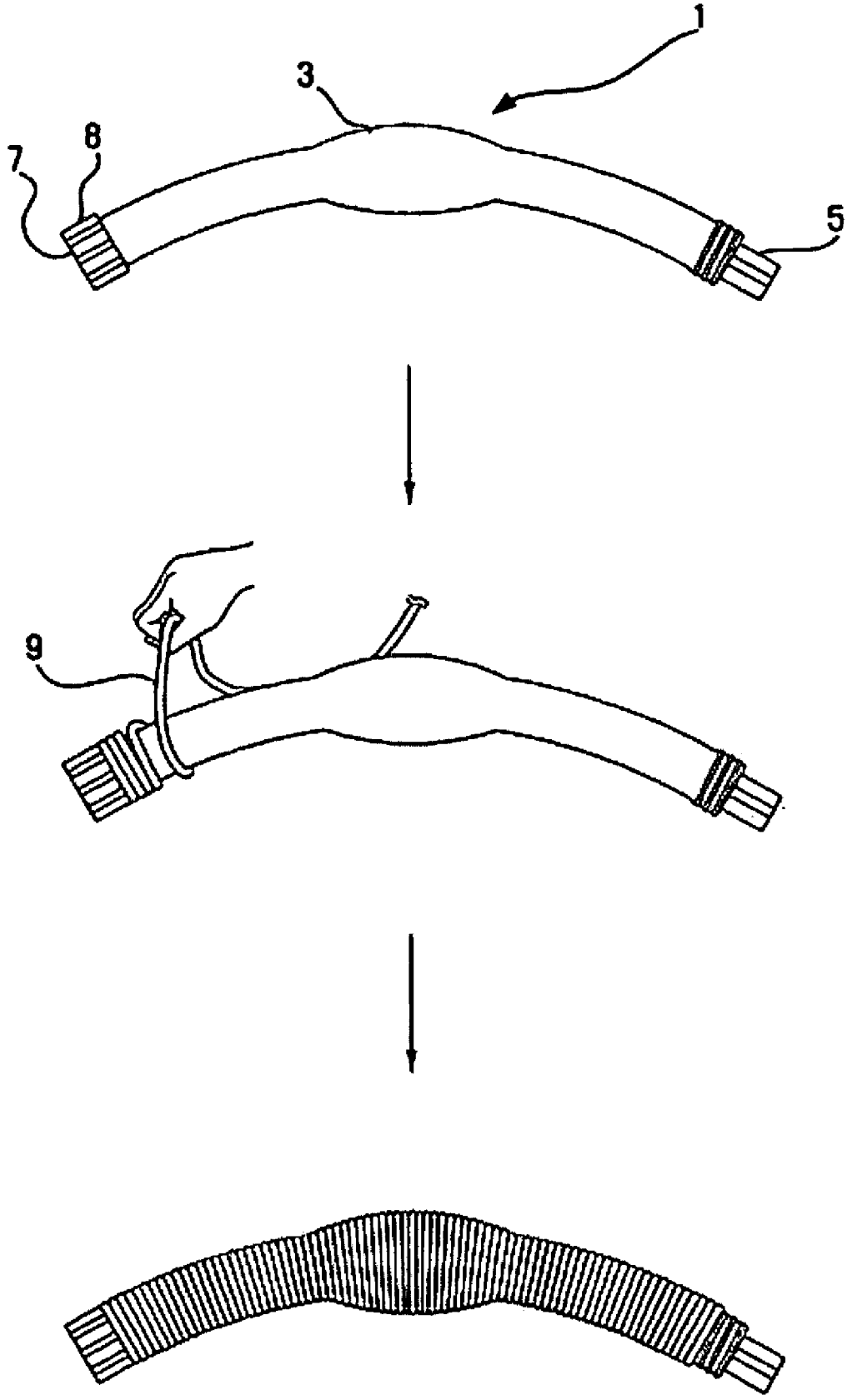
FIG. 1 is a process view illustrating the manufacture of a hula hoop in accordance with the present invention.
Figure 2:
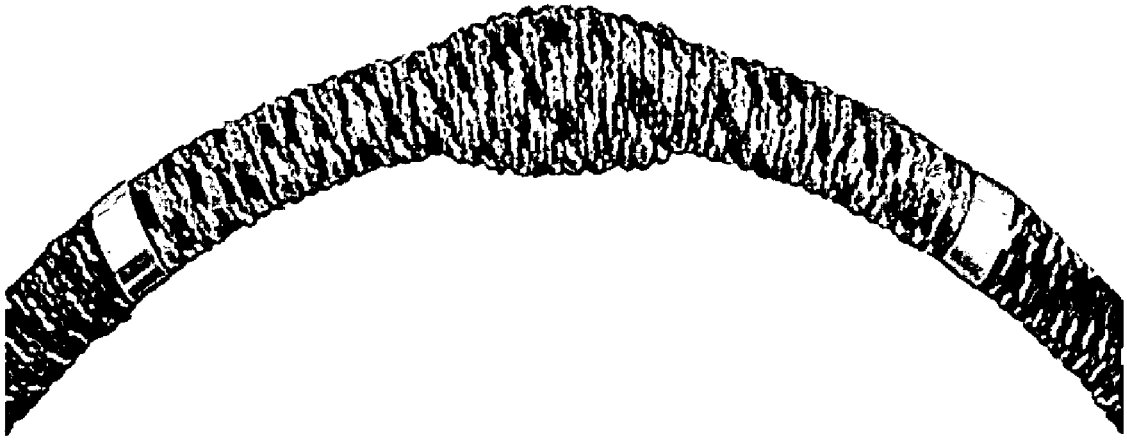
FIG. 2 is a partial enlarged photograph of the hula hoop in accordance with the present invention.
Figure 3:
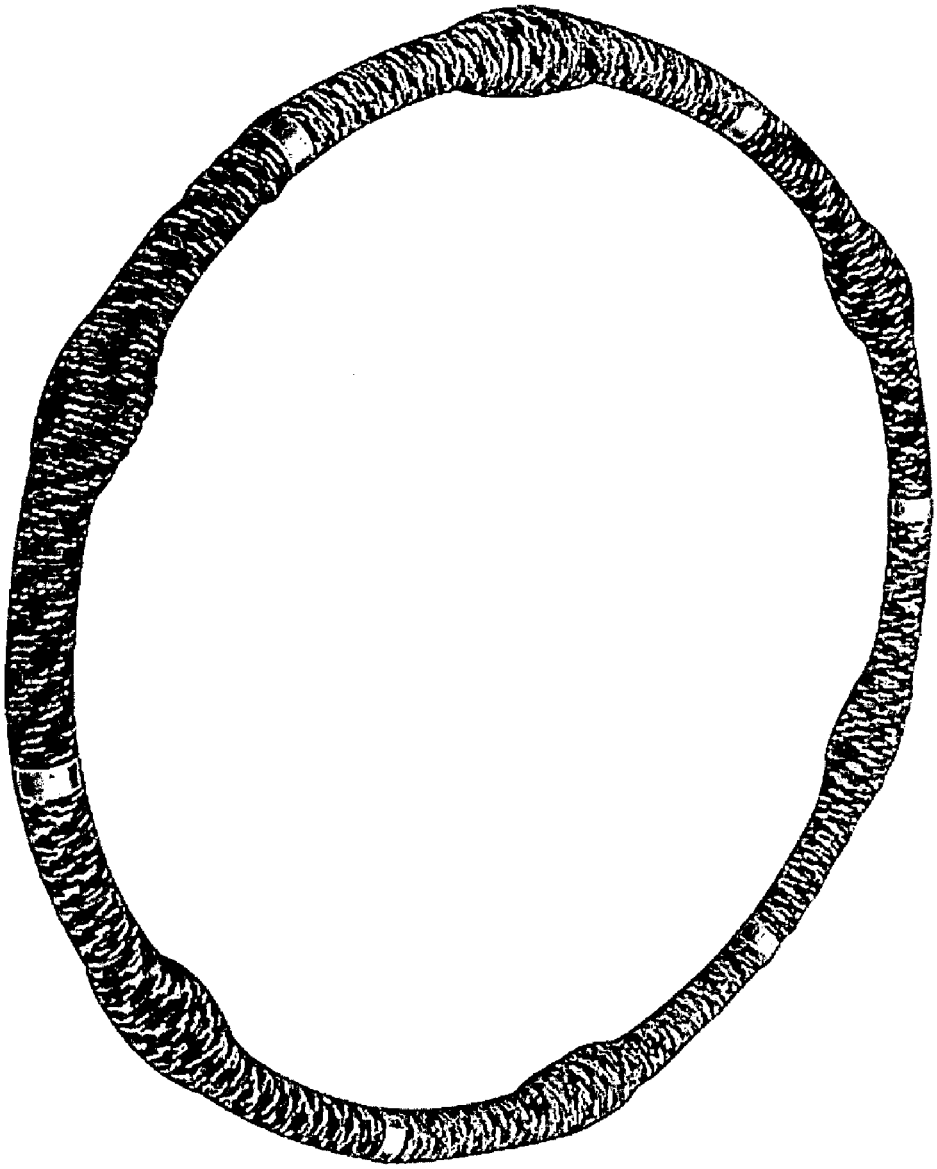
FIG. 3 is a perspective photograph of the hula hoop in accordance with the present invention.

FIG. 1 is a process view illustrating the manufacture of a hula hoop in accordance with the present invention. FIG. 2 is a partial enlarged photograph of the hula hoop in accordance with the present invention. FIG. 3 is a perspective photograph of the hula hoop in accordance with the present invention.

As shown in FIG. 1 in detail, the hula hoop of the present invention is fabricated by assembling a plurality of arched coupling units 1 in sequence to form a circular assembly. Specifically, each coupling unit 1 is centrally formed with an expanded acupressure portion 3, and has one end formed into a bolt-shaped coupling portion 5 and the other end formed into a nut-shaped coupling portion 7. As a result of providing the bolt- and nut-shaped coupling portions 5 and 7 at opposite ends of each coupling unit 1, each coupling unit 1 can be forcibly fitted into and fastened, at opposite ends thereof, to the neighboring coupling units 1 to complete the circular hula hoop. Here, the plurality of coupling units 1 may be fabricated simultaneously by molding.

Each of the coupling unit 1 is densely wound, throughout an outer peripheral surface of the overall body thereof except for the coupling portions 5 and 7, by a braid 9 that is made by interweaving a plurality of strands. Also, metal or plastic connecting members 8 are fitted around the respective coupling portions between the neighboring coupling units 1 in the course of assembling of the coupling units 1. To obtain a desired size, it is appropriate to assemble six coupling units in the case of a children's hula hoop and eight coupling units in the case of an adult hula hoop.

Preferably, the above mentioned braid 9 may be, for example, made by interweaving sixteen strands. In the present invention, although the strands may have the same color as one another, it is desirable that the strands have different colors from one another or belong to the same color tone to obtain a variety of color combinations of braids, in order to guarantee an outstanding and aesthetic outer appearance of the hula hoop. This has the effect of providing a user with aesthetic appreciation when using the hula hoop in playing or exercise, and furthermore, achieving high interior decorative effect even when the hula hoop is simply placed in a room.

As can be understood, it is most important for the hula hoop to achieve a high structural strength against shock caused during playing or exercise. In the present invention, the durability of the hula hoop can be improved by appropriately selecting a finishing method of the braid wound on the hula hoop. For example, winding beginning and ending portions of the braid 9 wound on the outer peripheral surface of each coupling unit 1 may be thermally bonded to be integrated to the outer peripheral surface of the coupling unit 1. Alternatively, each coupling unit 1 may be perforated with holes at positions corresponding to the winding beginning and ending portions of the braid 9 and both the beginning and ending portions of the braid 9 are knotted in the holes after the braid 9 is wound on the coupling unit 1. Yet alternatively, the winding beginning and ending portions of the braid 9 may be pushed below the braid 9 that is tightly wound on the associated coupling unit 1, so as to be captured and fixedly maintained below the braid 9 by a winding force of the braid 9.

As apparent from the above description, the hula hoop of the present invention provides the following effects.

Firstly, the hula hoop of the present invention provides a user with strong acupressure stimulation. Such an acupressure function cannot be obtained by conventional simple plastic hula hoops, and therefore, the hula hoop of the present invention can achieve an improvement in exercise effect.

Secondly, as a result of winding a braid, which is made by interweaving sixteen strands, on an outer peripheral surface of each unit of the hula hoop, the hula hoop of the present invention can provide a user with soft fiber contact feeling rather than a hard plastic contact feeling in use. Furthermore, the braid has the effect of allowing the hula hoop to cling to the user's body by virtue of its weight. This has the effect of enabling the user for enjoying playing the hula hoop for an increased time.

Thirdly, the hula hoop of the present invention can achieve an outstanding aesthetic outer appearance by virtue of various colors of braids wound thereon. As a result, the hula hoop can be recognized as a good interior decorative article as well as aesthetic exercise equipment.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A hula hoop comprising a plurality of arched coupling units, which are plastic molded articles and coupled to one another in sequence to complete a circular assembly, wherein:

each coupling unit is centrally formed with an expanded acupressure portion;

each coupling unit has one end formed into a bolt-shaped coupling portion and the other end formed into a nut-shaped coupling portion such that the bolt-shaped coupling portion of one coupling unit is forcibly fitted into and fastened to the nut-shaped coupling portion of another neighboring coupling unit;

each coupling unit is densely wound, throughout an outer peripheral surface of the overall body thereof except for the coupling portions, by a braided cord that is made by interweaving a plurality of strands and takes any one configuration selected from the group consisting of:

the beginning and ending portions of the braid are thermally bonded to be integrated to the outer peripheral surface of the coupling unit:

each coupling unit is perforated with holes at positions corresponding to the beginning and ending portions of the braided cord, where the winding beginning and ending portions of the braid are knotted in the holes after the braided cord is wound on the coupling unit; and the winding beginning and ending portions of the braided cord are pushed below the braided cord tightly wound on the coupling unit to be caught and held fast by a winding force of the braided cord; and metal or plastic connecting members are fitted around the respective coupling portions between the neighboring coupling units in the course of assembling of the coupling units.

2. The hula hoop according to claim 1, wherein six coupling units are assembled to constitute a children's hula hoop, and eight coupling units are assembled to constitute an adult hula hoop.

3. The hula hoop according to claim 1, wherein the braid is made by interweaving sixteen strands.

4. A hula hoop comprising a plurality of arched coupling units, which are plastic molded articles and coupled to one another in sequence to complete a circular assembly, wherein:

each coupling unit is centrally formed, including an expanded acupressure portion that is continuous and coaxial with the coupling unit;

each coupling unit has one end formed into a bolt-shaped coupling portion and the other end formed into a nut-shaped coupling portion such that the bolt-shaped coupling portion of one coupling unit is forcibly fitted into and fastened to the nut-shaped coupling portion of another neighboring coupling unit;

each coupling unit is densely wound, throughout an outer peripheral surface of the overall body thereof except for the coupling portions, by a braid that is made by interweaving a plurality of strands; and metal or plastic connecting members are fitted around the respective coupling portions between the neighboring coupling units in the course of assembling of the coupling units.

* * * * *